US005551172A

United States Patent [19]

Yu

[11] Patent Number: 5,551,172

[45] Date of Patent: Sep. 3, 1996

[54] VENTILATION STRUCTURE FOR A SHOE

[76] Inventor: Simon S. C. Yu, 3806 Whittle Ave., Oakland, Calif. 94602

[21] Appl. No.: 427,906

[22] Filed: Jul. 31, 1995

Related U.S. Application Data

[63] Continuation-in-part of Ser. No. 294,391, Aug. 23, 1994, abandoned.

[51] Int. Cl.[6] ..... A43B 7/10

[52] U.S. Cl. ..... 36/3 A; 36/3 R

[58] Field of Search ..... 36/3 A, 3 R, 3 B, 36/100, 101, 15

[56] References Cited

U.S. PATENT DOCUMENTS

| | | | |
|---|---|---|---|
| 1,797,309 | 3/1931 | Wojciechowski | 36/3 A |
| 2,147,197 | 2/1939 | Glidden | 36/3 A X |
| 2,200,080 | 5/1940 | Fein | 36/2.5 |
| 2,205,091 | 6/1940 | Geffner | 36/2.5 |
| 2,235,490 | 3/1941 | Saksa | 36/1 |
| 2,345,187 | 3/1944 | Evans | 36/2.5 |
| 2,356,490 | 8/1944 | Crotty | 36/3 A X |
| 2,507,120 | 5/1950 | Shapiro | 36/15 X |
| 3,925,915 | 12/1975 | Colli | 36/101 X |
| 4,103,440 | 8/1978 | Lawrence | 36/101 |
| 4,333,248 | 6/1982 | Samuels | 36/72 R |
| 4,745,963 | 5/1988 | Brown | 36/15 X |
| 4,835,883 | 6/1989 | Tetrault et al. | 36/3 R |
| 4,837,948 | 6/1989 | Cho | 36/3 A |
| 5,357,689 | 10/1994 | Awai | 36/3 A |

FOREIGN PATENT DOCUMENTS 874066 8/1961 United Kingdom .

*Primary Examiner*—Ted Kavanaugh
*Attorney, Agent, or Firm*—Bielen, Peterson & Lampe

[57] ABSTRACT

A ventilation structure for a shoe having a sole portion and a connected upper portion utilizing an aperture or slit that is formed through the upper portion of the shoe. The aperture extends along a dimension of the upper portion of the shoe and is overlain with a mesh layer connected to the upper portion of the shoe. A closure, such as a zipper, shuts at least a portion of the aperture and blocks at least a portion of the mesh layer from passage of air from the exterior to the interior of the shoe. The toe portion of the shoe may be further provided with an opening overlain with mesh that is openable or closable with a flap.

16 Claims, 3 Drawing Sheets

VENTILATION STRUCTURE FOR A SHOE

CROSS-REFERENCE TO RELATED APPLICATIONS

The present application is a Continuation-In-Part of the prior filed application, Ser. No. 08/294,391, filed 23 Aug. 1994, now abandoned

BACKGROUND OF THE INVENTION

The present invention relates to a novel and useful ventilation structure for a shoe.

Myriad designs for footwear have been proposed in the past. In general, footwear is designed to protect the feet of the user and is seasonable in nature. That is to say, footwear used in hot weather is not often adaptable to cold weather use as well.

In past, shoe designs have been proposed which render shoes usable for only hot weather or cold weather use. For example, U.S. Pat. Nos. 2,235,490 and 4,333,248 describe a shoe protector which is attachable to a shoe for the purpose of protection of the shoe.

U.S. Pat. Nos. 2,200,080, 2,205,091, 2,345,187, 4,103,440, and British patent 874,066 all describe systems for replacing the upper portions of shoes by detachment of the same from the sole portion of the shoe. In many cases, zippers are employed in this regard.

A system for ventilating a shoe and converting a shoe structure from hot weather to cold weather use without complete replacement of the upper portion would be a notable advance in the clothing field.

SUMMARY OF THE INVENTION

In accordance with the present invention a novel and useful ventilation structure for a shoe is herein provided.

The ventilation structure of the present invention utilizes a shoe having a sole portion that is connected to an upper portion. An aperture is formed through the upper portion of the shoe to provide communication between the exterior and the interior of the shoe. The aperture may take the form of a single aperture or a multiplicity of apertures formed about the perimeter of the upper portion of the shoe. In any case, each of the apertures is fitted with a mesh layer connected to the upper portion of the shoe and in overlying relationship with any of the apertures formed in the upper portion of the shoe. Closure means in the form of zippers may be employed to shut at least a portion of the each of the apertures to block the movement or convection of air from the exterior to the interior of the shoe. The closures in the form of zippers may include multiple sliders for this purpose.

When any of the apertures are closed or shut, a chamber may be formed between the shut aperture and the overlying mesh layer. In such a case, a partition of solid material may be placed within the chamber to further block moisture and convection currents, especially currents moving from the exterior to the interior of the shoe.

Moreover, an opening in the toe portion of the shoe may be formed at a distance which is greater from the sole portion of the shoe than any of the prior described apertures. The toe portion opening may also be formed with an overlying mesh layer and include a flap which is movable from an open to a closed position, and may be fixed in either one of these positions. Thus, cross ventilation is created between any one of the apertures and the toe portion of the shoe.

It may be apparent that a novel and useful ventilation structure for a shoe has been heretofore described.

It is therefore an object of the present invention to provide a ventilation structure for a shoe which includes apertures which permit ventilation within the upper portion of the shoe and yet provides an overlying mesh layer which serves to block solid objects, such as rocks, sand, insects, and the like from entering the interior of the shoe.

Another object of the present invention is to provide a ventilation structure for a shoe which tends to scoop or pump air through apertures in the shoe during normal walking by the wearer of the shoe.

A further object of the present invention is to provide a ventilation structure for a shoe which provides a plurality of openings and apertures to create cross ventilation which is especially useful in extremely hot weather.

Yet another object of the present invention is to provide a ventilation structure for a shoe which obviates the need to wear multiple sets of shoes depending on the weather conditions encountered by the user of the shoes.

Another object of the present invention is to provide a ventilation system for a shoe which may be quantitatively adjusted according to the determining weather conditions and permits the user to either walk or run.

Yet another object of the present invention is to provide a ventilation structure for a shoe which results in a shoe having an aesthetic appearance not unlike shoes of conventional configuration.

The invention possesses other objects and advantages especially as concerns particular characteristics and features thereof which will become apparent as the specification continues.

For a better understanding of the invention references is made to the following detailed description of the preferred embodiments thereof which should be taken in conjunction with the hereinabove described drawings.

DETAILED DESCRIPTION OF THE PREFERRED EMBODIMENTS

Various aspects of the present invention will evolve from the following detailed description of the preferred embodiments which should be referenced to the prior described drawings.

Figure 1:
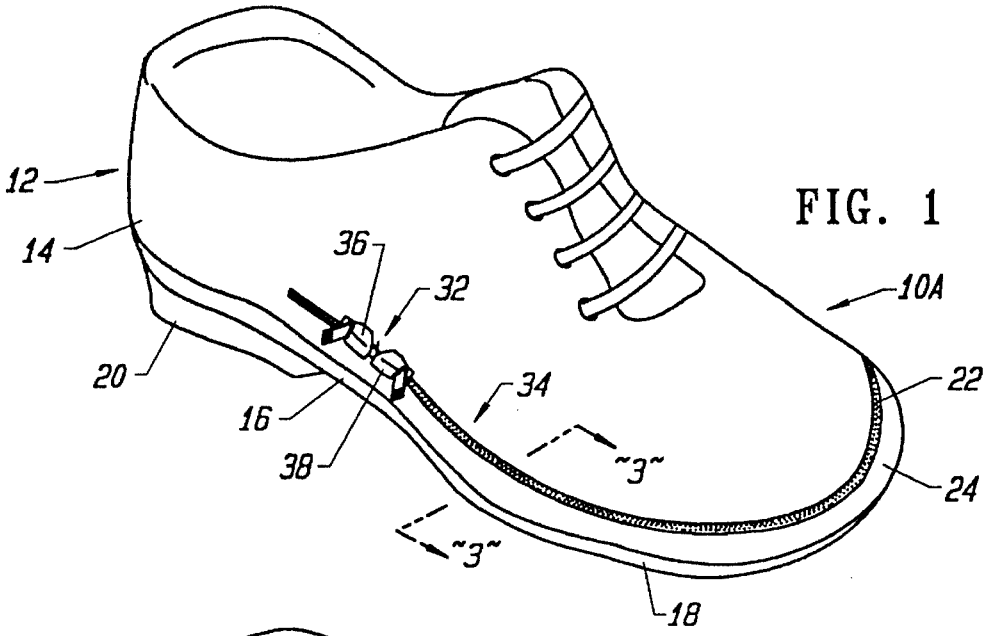
FIG. 1 is a top right perspective view of an embodiment of the present invention.
Figure 2:
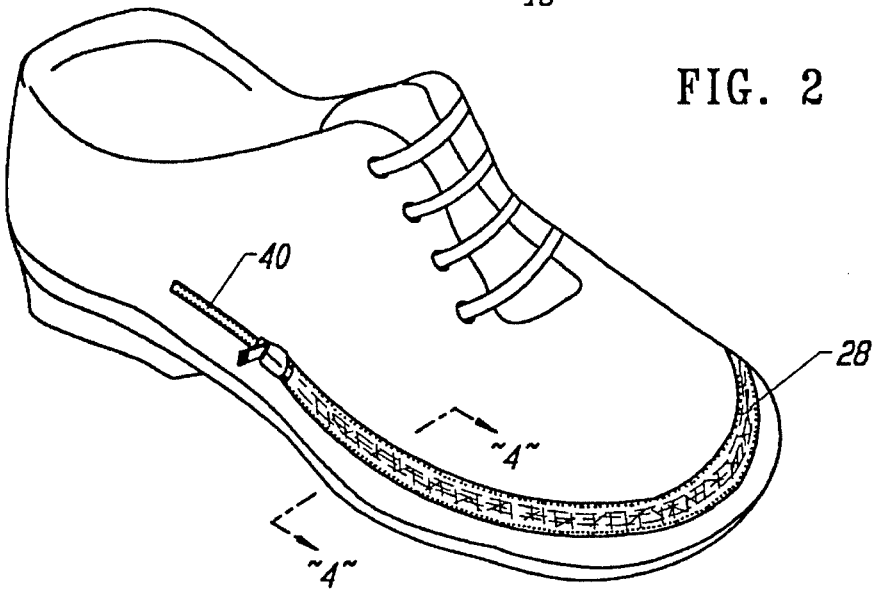
FIG. 2 is a top right perspective view of the embodiment of the invention depicted in FIG. 1 with the zipper portion open.

The invention as a whole is depicted in the drawings by reference character 10 and an upper case letter denoting various embodiments of the same. FIG. 1 depicts embodiment 10A of the invention in which a shoe 12 is depicted having an upper portion 14 and a lower portion 16 including a sole 18 and a heel 20. Ventilation structure 10A includes an aperture 22 formed in the upper portion 14 of shoe 12. Aperture 22, FIG. 1 takes the form of a slit which extends from the right side of shoe 12, about toe portion 24, and to the left side of shoe 12. Aperture 22 extends from the exterior of shoe 12 to the interior 26, thereof. Thus, convection currents may pass through shoe 12 in this regard. With reference to FIG. 2, it may be observed that mesh layer 28 is fastened to the interior surface 30 of upper portion 14 of shoe 12, by any suitable means such as gluing, sewing, stapling, and the like. Thus, solid objects are prevented from passing from the exterior to the interior 26 of shoe 12. Mesh layer 28 may be of any suitable size and structure. For example, mesh layer 28 may be formed of nylon, cotton, and other suitable materials. Mesh layer 28 is necessarily flexible and preferably soft.

Figure 3:
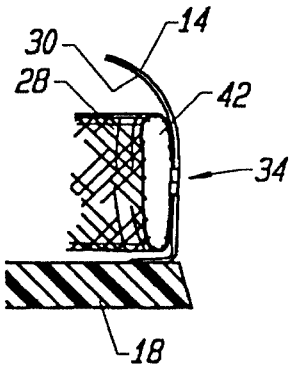
FIG. 3 is a sectional view taken along line 3—3 of FIG. 1.
Figure 4:
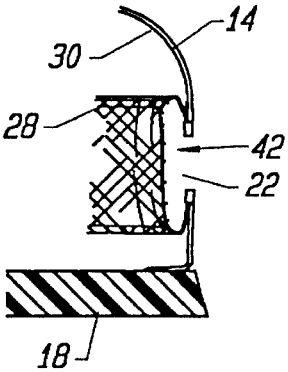
FIG. 4 is a sectional view taken along line 4—4 of FIG. 2.
Figure 5:
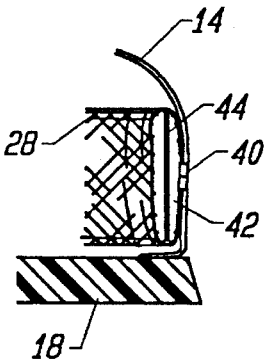
FIG. 5 is another embodiment of the invention depicting a partition in the chamber shown in FIG. 3.

Closure means 32 is also depicted in the present invention to shut at least a portion of aperture 22. Turning to FIGS. 3 and 4, it may be observed that closure means takes the form of a zipper 34 having sliders 36 and 38 which close tooth portion 40 in a conventional manner. Of course, other closure means may be employed such as VELCRO fasteners, snaps, and the like. FIG. 4 shows zipper 34 in an open position along aperture 22. It should be noted that chamber 42 is formed between zipper 34 and mesh layer 28. Turning to FIG. 5, it may be observed that partition 44 has been inserted within chamber 42 in order to positively block moisture and/or convection currents passing through zipper teeth 40. This is especially useful in windy and cold weather. In other words, partition 44 may be employed to winterize embodiment 10A, or when zipper 34 is not opened for long periods of time.

Figure 6:
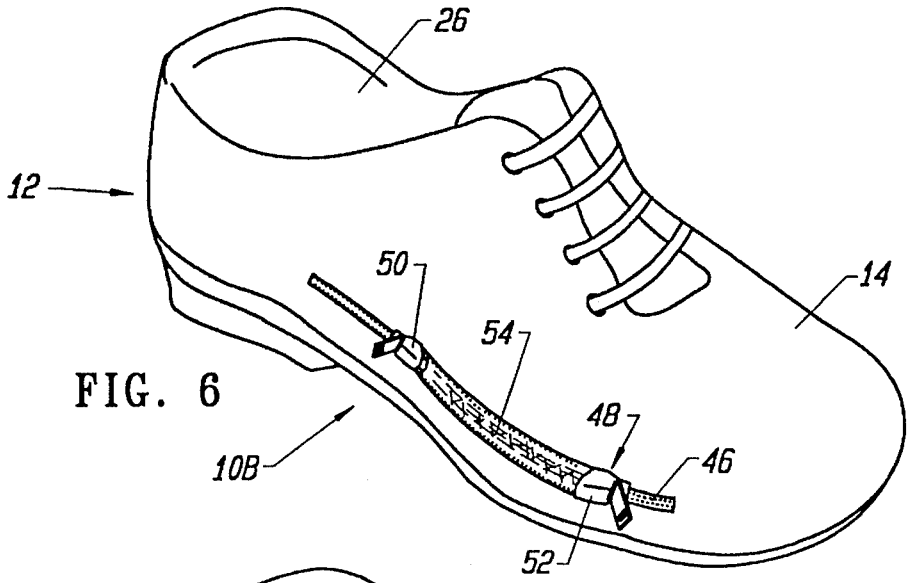
FIG. 6 is a top right perspective view of yet another embodiment of the present invention.

Turning to FIG. 6, it may be apparent that another embodiment 10B of the ventilation structure of the present invention is depicted. Structure 10B includes an aperture 46 which is rather short on upper portion 14 of shoe 12. Zipper 48 including sliders 50 and 52 permit ventilation to enter the interior 26 of shoe 12 only through the side of upper 14, and to a degree dependant on the opening allotted by zipper 48. Mesh layer 54 overlies aperture 46 and is fastened in a manner similar to that depicted with respect to mesh layer 28 and aperture 22, FIGS. 1–5.

Figure 7:
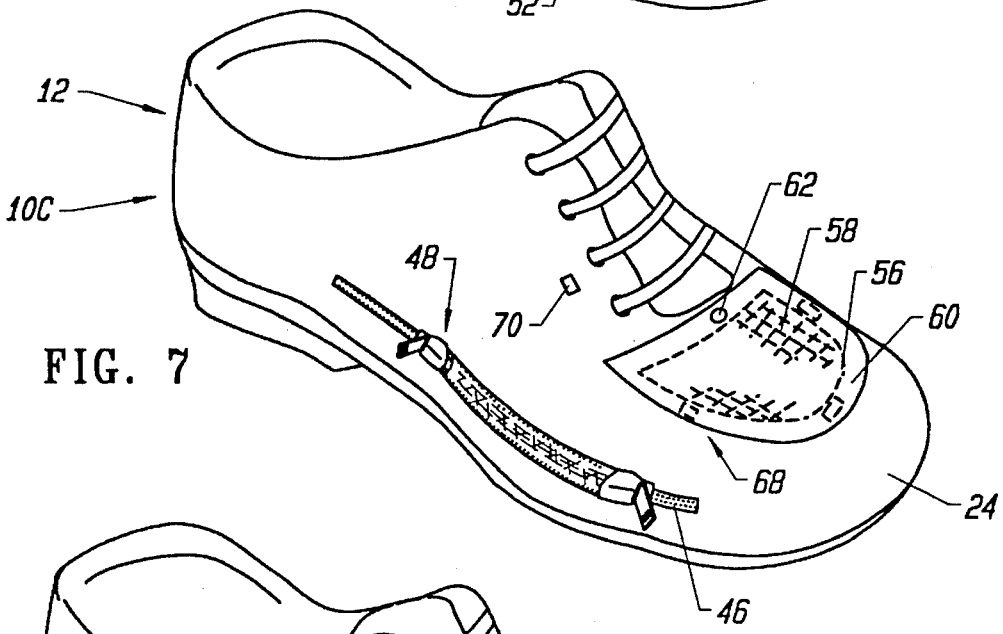
FIG. 7 is a top right perspective view of yet another embodiment of the present invention.
Figure 8:
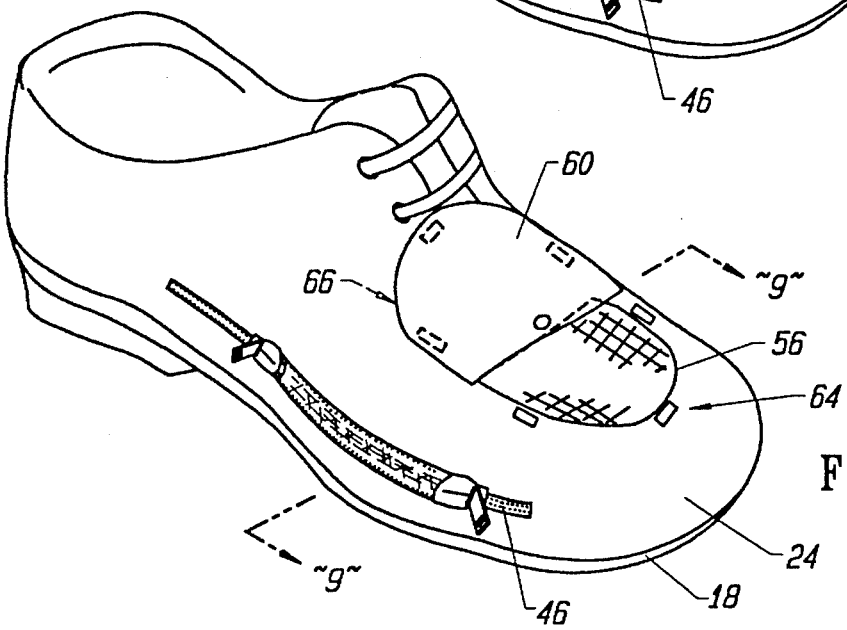
FIG. 8 is a top right perspective view of the embodiment depicted in FIG. 7 with the flap portion in an open position.

FIG. 7 shows yet another embodiment 10C of the present invention in which shoe 12 includes the aperture 46 and zipper 48 found in FIG. 6 with respect to embodiment 10B. However, an opening 56 of roughly a semi-oval construction has been formed in the toe portion 24 of shoe 12. Opening 56 is further from sole 18 than aperture 46. Opening 56 is fitted with a mesh layer 58 which is attached to upper portion 14 of shoe 12 by sewing, gluing, riveting, and the like. A flap 60 is held to the upper 14 of shoe 12 by rivet 62 and is capable of rotating into an open or closed position. FIG. 7 shows flaps 60 in a closed position while FIG. 8 illustrates flap 60 being in an open position. Plurality of hook and pile closures 64 and 66 on toe portion 24 of shoe 12 and flap 60, respectively, permit the closure of flap 60 in the position shown in FIG. 7. Flap 60 may be fastened in an open position as shown in FIG. 8 by the use of plurality of hook and pile fasteners 68 and corresponding hook and pile fasteners, such as exemplary hook fastener 70 formed on the upper portion 14 of shoe 12, FIG. 7.

Figure 9:
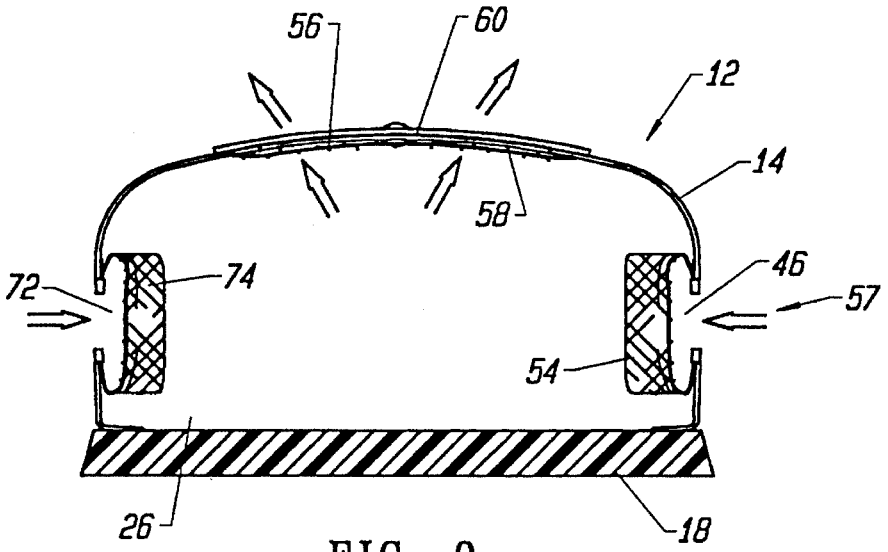
FIG. 9 is a sectional view taken along line 9—9 of FIG. 8.

Turning to FIG. 9, it may be apparent that apertures 46 and 72, overlain by mesh layers 54 and 74, respectively, are formed on the right and left sides of shoe 12 upper portion 14. With flap 60 in the open position, ventilation currents may pass through apertures 46 and 72 and out opening 56 according to directional arrows 57 on FIG. 9. However, such ventilation may be reversed by the natural walking motion of the user which tends to pump air in and out of the interior 26 of shoe 12, in which case arrows 56 would be reversed in orientation.

Figure 10:
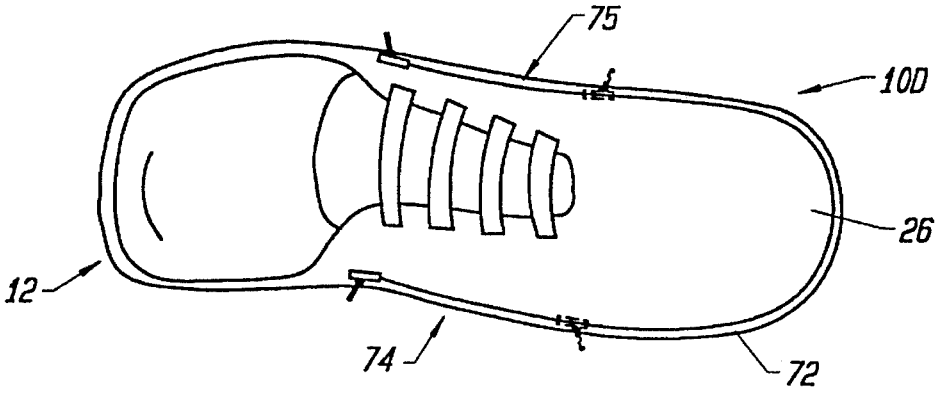
FIG. 10 is a schematic top plan view of yet another embodiment of the present invention.
Figure 11:
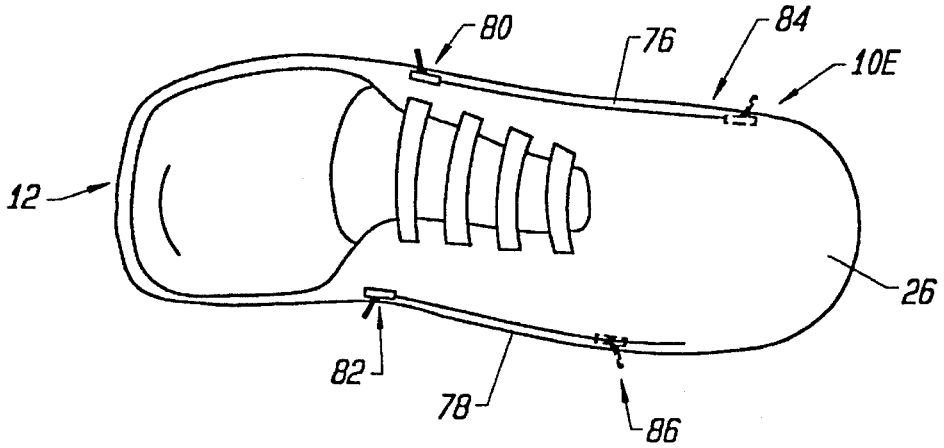
FIG. 11 is a schematic top plan view of yet another embodiment of the present invention.

FIG. 10 and FIG. 11 schematically represent embodiments 10D and 10E in which shoe 12 includes an aperture 72 which travels from the right side, around toe portion 26 and to the left side of shoe 12, FIG. 10. Embodiment 10D includes a quartet of sliders 74 with respect to zipper structure 75, FIG. 10. Embodiment 10E, FIG. 11, includes a pair of apertures 76 and 78 having zipper structures 80 and 82, which do not extend around the toe portion 26 of shoe 12. Zipper structures 80 and 82 each include a pair of sliders 84 and 86, respectively. In the embodiments depicted in FIGS. 10 and 11 apertures 72, 76, and 78 are each fitted with mesh layers similar to those shown with respect to aperture 22 of FIG. 1.

In operation, the user of embodiments 10A–10E would open the apertures using the particular zipper structures shown in the drawings to a degree permitting adequate ventilation to the interior 26 of shoe 12. In addition, air would pass through any of the apertures shown in the embodiments 10A–10E by the normal walking action associated with the user of shoe 12. In extremely cold and/or windy weather, partition 44 may be employed, FIG. 5 to more positively seal aperture 22. Moreover, partition 44 may be waterproof to prevent moisture from entering interior 26 of shoe 12. Vent opening 56 and toe portion 26 of shoe 12 is also employed in conjunction with any one of the apertures formed along sides of upper portion 14 of shoe 12 closer to sole 18. Flap 60 may be opened or closed to permit such cross ventilation as depicted in FIG. 9 of the drawings. It has been found that the ventilation structures 10A–10E are versatile in use and permit the user of shoe 12 to wear the same in a variety of weather conditions.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A ventilation structure in combination with a shoe having a sole portion and a connected upper portion, the improvement comprising:

a. an aperture through the upper portion of the shoe providing communication between the exterior and the interior of the shoe, said aperture extending along a dimension of the upper portion of the shoe;

b. a mesh layer connected directly to the upper portion of the shoe in overlying relationship with said aperture; and c. closure means for shutting at least a portion of said aperture by drawing said upper portion to itself and blocking at least a portion of said mesh layer thereby, said shut aperture forming a chamber between the shut aperture and said overlying mesh layer on the interior of the upper portion of the shoe.

2. The ventilation structure of claim 1 which additionally comprises a partition sized to fit within said chamber.

3. The ventilation structure of claim 1 in which said closure means is a zipper.

4. The ventilation structure of claim 3 in which said zipper includes a plurality of sliders.

5. The ventilation structure of claim 1 in which said aperture is a first aperture and further includes a second aperture through the upper portion of the shoe, said second aperture extending along a dimension of the upper portion of the shoe, and in which said closure means is a first closure means for shutting at least a portion of said first aperture and further includes a second closure means for at least partially shutting said second aperture.

6. The ventilation system of claim 5 in which said first and second closure means are first and second zippers, respectively.

7. The ventilation system of claim 6 in which said first and second zippers each include a plurality of sliders.

8. The ventilation structure of claim 1 which additionally comprises an opening in the toe portion of the shoe at a greater distance from the sole than said aperture.

9. The ventilation structure of claim 8 in which said opening includes a mesh layer overlying said toe portion opening.

10. The ventilation structure of claim 9 which further comprises a flap overlying said toe portion opening, said flap being capable of being selectively positioned to open and close said toe portion opening.

11. The ventilation structure of claim 8 which additionally comprises a chamber formed between said shut aperture and said overlying mesh layer and a partition sized to fit within said chamber.

12. The ventilation structure of claim 11 in which said closure means is a zipper.

13. The ventilation structure of claim 12 in which said zipper includes a plurality of sliders.

14. The ventilation structure of claim 13 in which said aperture is a first aperture and further includes a second aperture through the upper portion of the shoe, said second aperture extending along a dimension of the upper portion of the shoe, and in which said closure means is a first closure means for shutting at least a portion of said first aperture and further includes a second closure means for at least partially shutting said second aperture.

15. The ventilation structure of claim 14 in which said first and second closure means are first and second zippers, respectively.

16. The ventilation structure of claim 15 in which said first and second zippers each include a plurality of sliders.

* * * * *